United States Patent [19]

Carson

[11] Patent Number: 4,646,063

[45] Date of Patent: Feb. 24, 1987

[54] ELECTRONIC SIREN WITH REMOTE MULTIPLEXED CONTROL HEAD

[75] Inventor: William H. Carson, Oaklandon, Ind.

[73] Assignee: Carson Manufacturing Co., Indianapolis, Ind.

[21] Appl. No.: 493,644

[22] Filed: May 11, 1983

[51] Int. Cl.[4] ..... G08B 3/00

[52] U.S. Cl. ..... 340/384 E; 340/384 R; 340/405

[58] Field of Search ..... 340/384 E, 384 R, 405; 381/86; 179/2 EA, 2 EB

[56] References Cited

U.S. PATENT DOCUMENTS

| | | | |
|---|---|---|---|
| 4,075,624 | 2/1978 | Sheff | 340/384 R |
| 4,088,995 | 5/1978 | Paladino | 340/384 E |
| 4,189,718 | 2/1980 | Carson et al. | 340/384 R |
| 4,238,787 | 12/1980 | Pearlman et al. | 340/384 E |
| 4,363,028 | 12/1982 | Bosnak | 340/384 E |

OTHER PUBLICATIONS

"Multi-Option Siren", Ray Marston, Electronics Today Inc., vol. 10, No. 1.

*Primary Examiner*—John W. Caldwell, Sr.

*Assistant Examiner*—Tyrone Queen

*Attorney, Agent, or Firm*—Pearne, Gordon, McCoy & Granger

[57] ABSTRACT

The invention is a control apparatus for use in an electronic siren circuit which generates a plurality of siren and intelligible audio outputs. The control apparatus includes a control module of relatively small size which may be mounted in a limited space proximate to an operator and a relatively larger, receiver module which may be mounted in any convenient location in a vehicle. The control module and remote receiver module are coupled together by a transmission line. Circuitry is provided in the control module and receiver module for producing binary coded control signals and for decoding these signals respectively to produce control signals in the receiver module. Circuitry is also provided for multiplexing intelligible audio signals over the same transmission line and for discriminating between the binary coded control signals and intelligible audio signals and conditioning the power module to reproduce same using the high power amplifier circuit of the siren. Biasing control circuits are provided in both the control and receiver modules for altering the operating states of the apparatus.

29 Claims, 8 Drawing Figures

FIG 2a
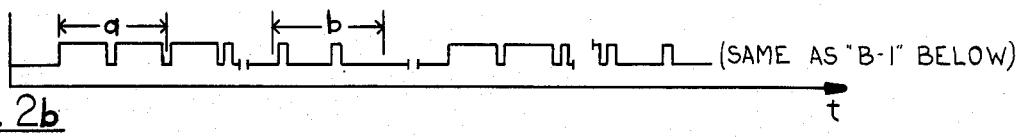
FIG. 2b
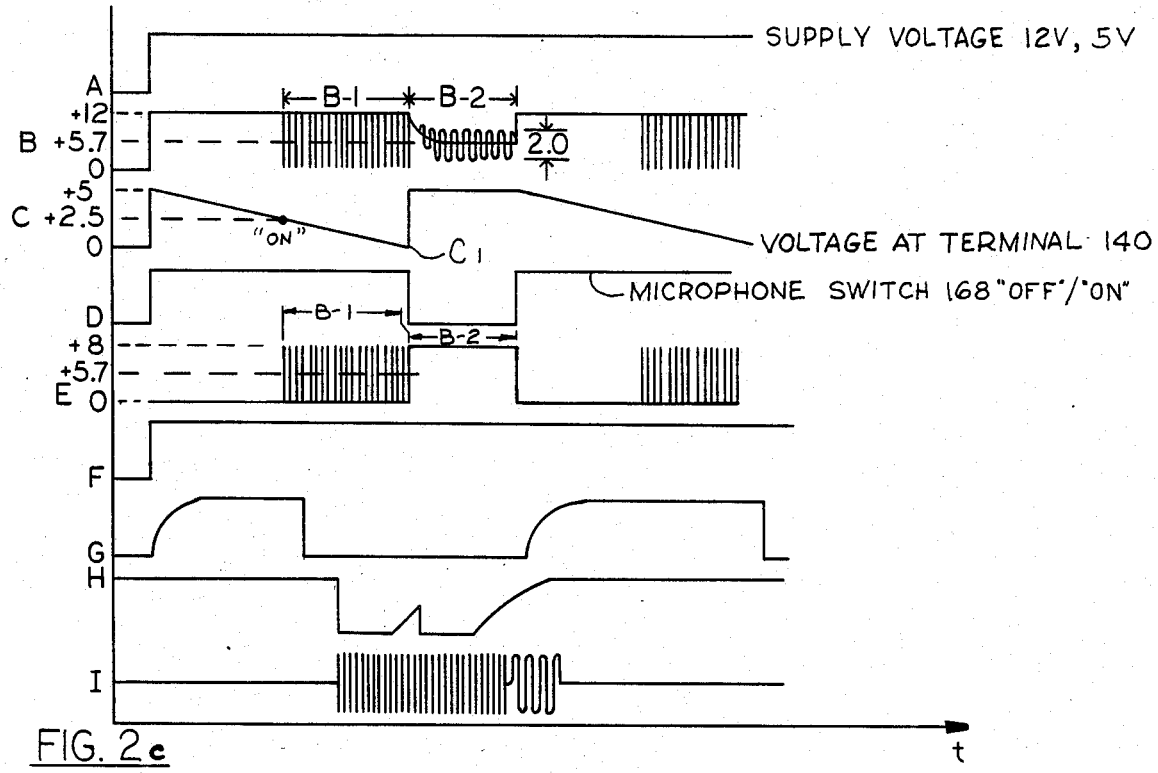
FIG. 2c
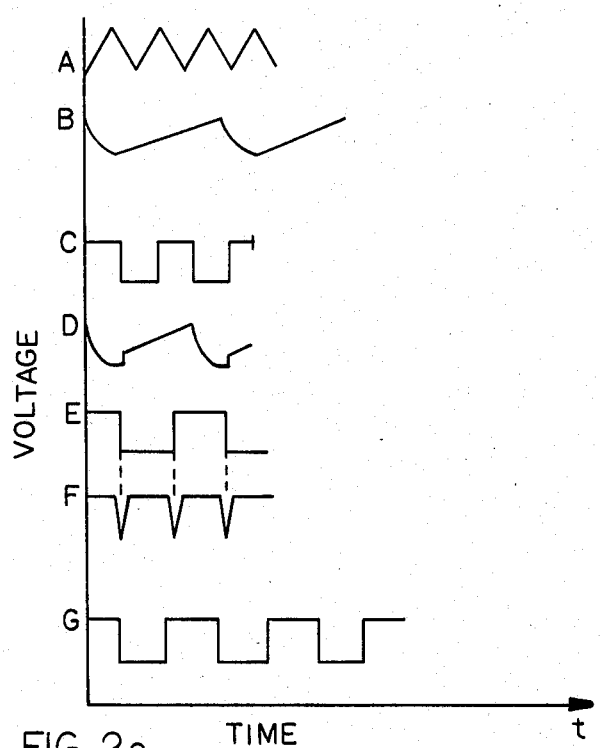
FIG. 2c

ELECTRONIC SIREN WITH REMOTE MULTIPLEXED CONTROL HEAD

BACKGROUND OF THE INVENTION

1. Field of the Invention

The present invention relates to an electronic siren and in particular to an electronic siren circuit having the signal generating and power amplifier contained in a first unit and a control head contained in a second unit located remotely from the first, the two units being interconnected by a multiplexing circuit which enables control of all functions of the siren from the remotely located control head through a communication conductor.

2. Description of the Prior Art

Electronic siren circuits such as that disclosed in U.S. Pat. No. 4,189,718 issued to William H. Carson et al and assigned to the assignee of this invention, are widely used, and typically include a waveform generating circuit which generates a manually selected one of a plurality of signals having predetermined frequency envelopes which are in turn used to control the frequency of a square wave generating circuit. The combination of the waveform generating circuit and a high power amplifier circuit in conjunction with a loud speaker produces the various siren sounds commonly referred to as a wail, yelp, and two-tone. Additionally, such circuits now frequently include circuitry which enables the siren circuit to function as a public address amplifier for a microphone carried in the vehicle to which the siren is attached, circuitry for coupling a vehicle's radio receiver to the siren amplifier so that incoming two way communications can be monitored from outside the vehicle, and circuitry for simulating high volume air horns typically carried in vehicles such as fire trucks.

Such circuits are designed to operate at relatively high power levels. Simultaneously, since such siren circuits are typically used in mobile vehicles, the available power for operating the circuits is limited thereby necessitating high efficiency circuitry. While modern electronic technology has enabled such circuits to be fabricated in relatively compact units, the continuing reduction in size of modern motor vehicles has imposed substantial and continuing reductions in the available space for mounting the siren circuits on or near the dashboard of the vehicle or similar locations convenient for control of the circuit. It has further been impractical to mount such a siren circuit in a position in the vehicle remote from the dashboard inasmuch as the circuit must be manually operated, for example, to select or control the desired siren tone.

To overcome the space problem, the siren has been packaged in two separate units, one relatively small, function selecting unit for mounting on the dash board and the other containing the power portion for mounting remotely, such as in the trunk of the car. Interconnecting conductors serve in communicating function selection between the units. In such a prior art arrangement, an electrical signal is transmitted over the conductors, this signal changing its characteristic for each selected function: this signal utilizes voltage changes between discrete functions. A problem arises by reason of extraneous voltages being induced into the conductor from such sources as a radio transmitter in the same vehicle, which causes unwanted voltage jumps in the signal and consequent accidental shifts in function selection.

SUMMARY OF THE INVENTION

In its broader aspects, the invention relates to a control apparatus for use in an electronic siren circuit which includes a small, compact control head having manually operable switch means for selecting from one of a plurality of siren functions and intelligible audio signals derived from one of a plurality of sources such as a radio or microphone, a multiplexing circuit responsive to the manually operable selecting means and a microphone switch for transmitting the selected control signal or intelligible audio signal over a transmission line to a remotely located waveform generating and power amplifying siren circuit.

In one embodiment the control head includes circuitry responsive to the signal selecting means for generating a plurality of parallel binary coded control signals or, in the alternative, generating an intelligible audio signal. A multiplexed encoder converts the parallel encoded data into a time serialized control signal. Alternatively, the control head circuit responds to operation of a microphone switch to transmit intelligible audio signals, the transmission of the control signals or audio signals occurring over a single conductor to a remotely located electronic siren circuit. The control head is also provided with an auxiliary circuit which permits overriding or altering the selected operating mode of the siren by an external control such as a horn ring. The remote receiver module includes a decoder for converting the serialized control signal into a parallel, static control signal. The static control signal is in turn applied to a ramp generator control circuit which generates a selected one of the predetermined frequency envelopes which, in conjunction with known siren circuitry, results in the production of the various siren sounds.

In its alternative mode of operation, the serial encoding and decoding circuitry is disabled, and the same single conductor is utilized to transmit intelligible audio signals, these signals also being applied to the remote receiver module. The remote receiver module includes a relatively high power, high efficiency power amplifier circuit which is operable in either a class AB or a class B mode for reproducing either the audio or siren signals at high power levels with minimal distortion and applying these signals to a loud speaker.

Various circuits are included for the elimination of noise, protecting the unit from excessive frequencies, voltage variations and transients occurring within the vehicle's electrical system, and preventing operation of the circuit in more than one mode at any time. The control head is small and can be easily mounted in limited space convenient to the operator. The larger and bulkier receiver module containing the waveform generating and power amplifier circuits can be mounted in any available location in the vehicle with only a single conductor extending therebetween. This simplifies installation, reduces noise problems, and reduces failures that can occur from multi-conductor wiring. The circuit may further be provided with circuitry for automatically reducing the siren circuit's power consumption when not in use thereby substantially reducing the load on the vehicle's electrical system without requiring an additional on/off switch and access to the power unit and ensuring that the siren circuit is in an operable "ready" state at all times.

In a specific aspect of the invention, the control head includes a manually operable selector switch for selecting siren sounds typically referred to as yelp, wail, and two-tone. The unit may also operate in a public address mode which enables a microphone to operate through the siren circuit, and a radio repeat mode in which the siren circuit receives, amplifies, and reproduces incoming two way communications on the siren's speaker.

In some embodiments of the invention, the siren circuit may also be operated to simulate an air horn, or be operated from auxiliary inputs and control devices such as a horn ring.

It is therefore an object of the invention to provide an improved electronic siren circuit having a remotely located control head.

It is another object of the invention to provide such a circuit having a small, compact control head for generating control and intelligible audio signals and a remotely located power receiver-amplifier, the control head and power amplifier being coupled through a single conductor and a multiplexing circuit.

Still another object of the invention is to provide such a circuit in which a remotely located control head generates one of a plurality of serialized siren control signals or transmitting intelligible audio signals.

Still another object of the invention is to provide such a circuit in which a single conductor is used to communicate between a remote control head and a receiver power amplifier circuit.

Another object of the invention is to provide an electronic siren circuit in which the siren frequency envelope generating circuitry, power amplifying circuitry, and protection circuits are located remotely from a control head, the operation of the circuitry being responsive to binary coded signals and intelligible audio signals to produce a selected one plurality of outputs on the siren speaker.

Yet another object of the invention is to provide a remote control apparatus for an electronic siren in which the power consumption of the power amplifier is automatically reduced when the siren is not in use without the use of an additional on/off switch.

Another object of the invention is to provide a control apparatus for an electronic siren in which a small, remotely located control head employs digital and switching circuitry to produce and transmit serial coded control signals and audio signals and a siren circuit that uses digital and switching circuitry for receiving and decoding the serial coded control signals and audio signals.

The above-mentioned and other features and objects of this invention and the manner of obtaining them will be more apparent and the invention itself will be best understood by reference to the following description of an embodiment of the invention taken in conjunction with the accompanying drawings.

Figure 3:
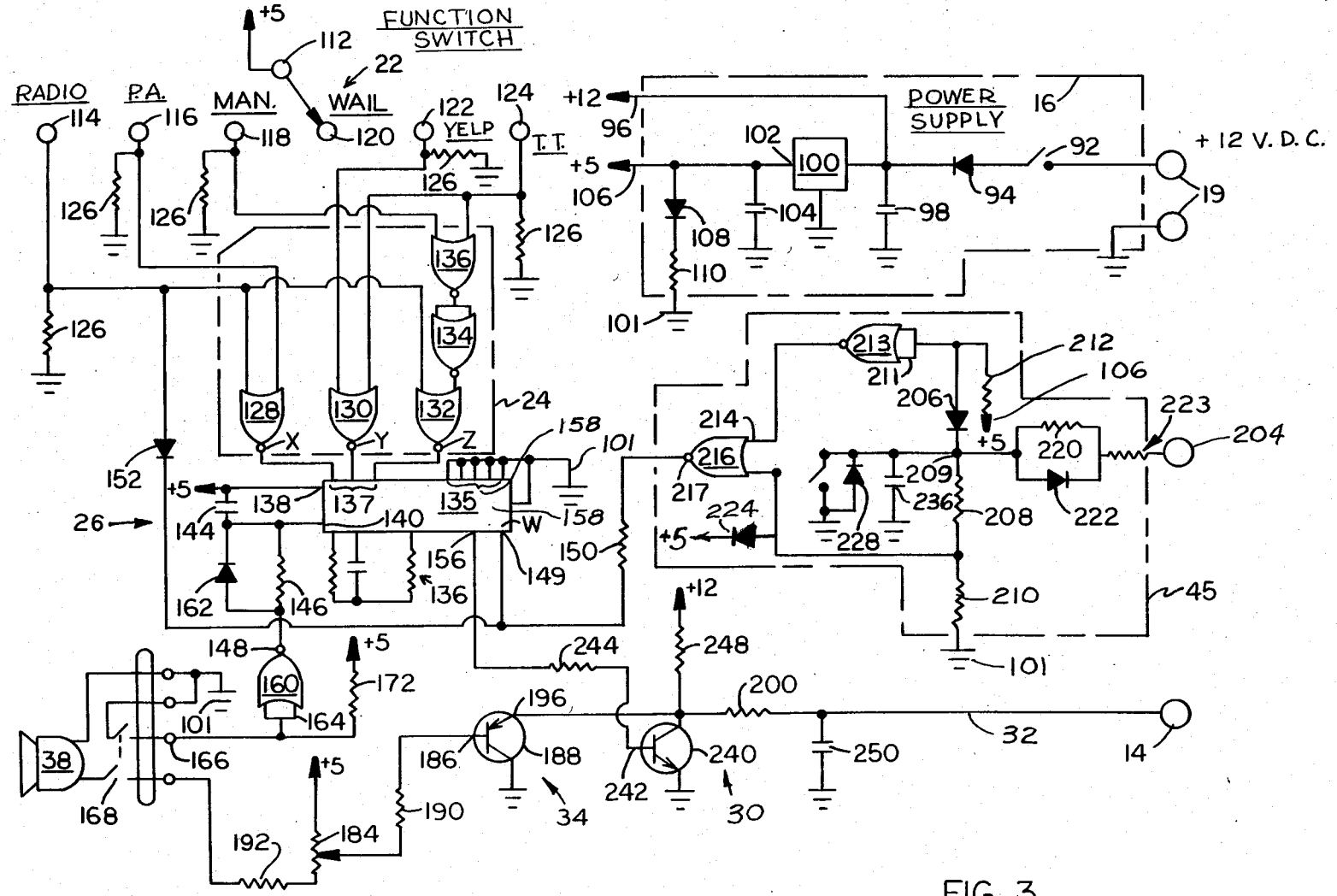

FIGS. *2a, 2b,* and *2c* are diagrams showing various waveforms appearing in the circuit and useful in explaining operation of the invention;

FIG. 3 is a circuit diagram of the control head portion of the present invention; and FIGS. *4a, 4b,* and *4c* are circuit diagrams of the receiver-amplifier circuit portion of the invention.

DESCRIPTION OF THE PREFERRED EMBODIMENT

Block Diagram and Circuit Overview

Figure 1:
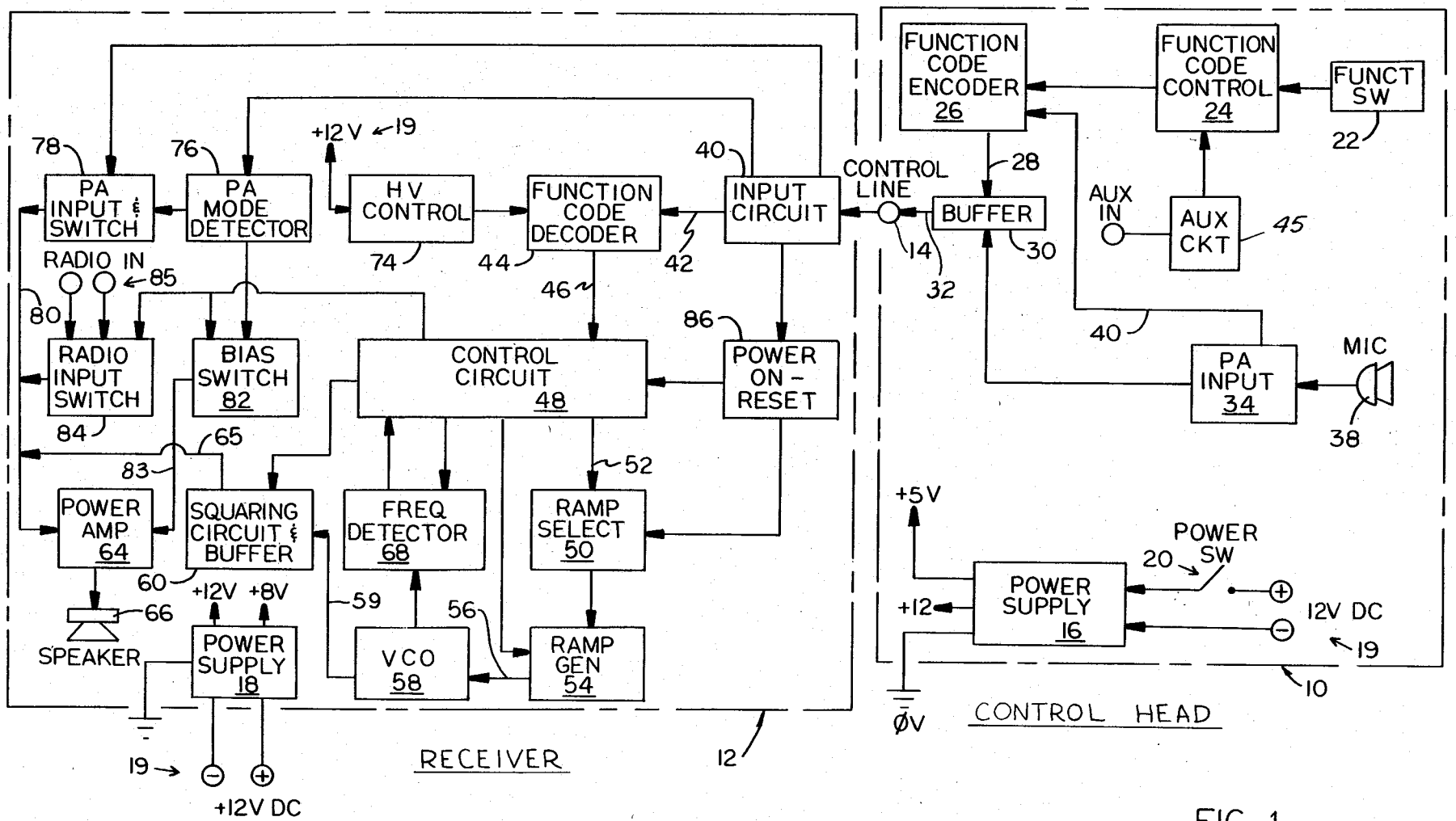
FIG. 1 is a block diagram of one embodiment of this invention.

Referring now to the drawings, there is shown in FIG. 1 a block diagram of the control head 10 and the receiver-amplifier 12 (referred to as the "receiver" hereinafter) units of the present invention. The control head 10 is relatively small and compact, so that it may be mounted in any convenient and accessible location of the vehicle, typically in the dashboard or on the steering column of the vehicle. The receiver 12 is larger and may be mounted at any desired location in the vehicle such as under a seat, in the vehicle's trunk or the like in accordance with available space. The control head 10 and receiver 12 are connected by means of a single conductor or control line 14 of any desired length. Both the control head 10 and receiver 12 are provided with individual power supplies 16 and 18, respectively, these power supplies in turn being connected directly to a vehicle's electrical system 19, typically, a conventional 12 volt direct current battery and alternator system. The control head power supply 16 is provided with an on/off switch 20 for selectively connecting and disconnecting the power supply 16 from the vehicle's electrical system 19 while power supply 18 of the receiver 12 is directly connected to this power source 19 at all times. Because the receiver 12 is remotely located such as, for example, in the trunk of the vehicle and is desired to minimize the number of conductors extending between the control head 10 and the receiver 12, power supply 18 is allowed to operate at all times. As will be explained in more detail, power consumption of the receiver 12, when not in use, is automatically reduced to a very low level such that it will not adversely affect the vehicle electrical system.

The control head 10 includes a function switch 22 which is manually operable into a selected one of six positions to select one of six available functions of a two-tone, yelp, or wail siren, manually controlled siren, public address or P.A., and radio repeat, functions. The switch 22 is operatively connected to a function code control 24, function code control 24 responding to the switch position to generate a predetermined one of a plurality of binary words or codes, there being one such code for each of the switch positions. This signal is static in the sense that it only changes when the function switch 22 is manually switched by an operator. This function code is applied as a parallel input signal to a function code encoder 26. The function code encoder converts the parallel binary signal from the function code control into a serialized binary signal. That is, the function encoder converts the static parallel binary signal received from the function code control 24 into a repetitive sequentially occurring time based pulse train. The sequentially occurring pulses are also binary coded and produce a serialized function code signal corresponding directly to the parallel function code signal from the function code control 24. The serialized data code appears on signal line 28 and is applied to a buffer circuit 30, buffer 30 functioning to filter and amplify the serialized function code signal and apply it to the control line 14.

Also contained in the control head 10 is a public address (P.A.) input circuit 34 which receives an intelligible audio signal from conventional microphone 38. The P.A. input circuit 34 is coupled through a signal line 41 to the function code encoder 26. The input circuit 34, produces a disabling signal on line 41 in response to depression of microphone 38 button (not shown in FIG. 1) thereby ensuring that the siren circuit will not produce a siren signal simultaneously with an audio signal from the microphone. Simultaneously, the P.A. input circuit 34 applies the microphone signal to the buffer circuit 30 which in turn conditions and amplifies the intelligible audio signal from the microphone and transmits the same over control line 14.

The signal appearing on the control line 14 is denominated "B" in FIG. 2*b* and comprises either a series of sequentially occurring pulses as indicated at B-1 or an intelligible audio signal which is at B-2.

Still referring to FIG. 1, the receiver 12 includes an input circuit 40 connected to the control line 14 to receive the signal from the buffer 30. Input circuit 40 is primarily a filter and amplifier and conditions the received signal to eliminate noise therefrom and invert it to restore the control signal polarity as in wave "E". When the signal is in fact a serial binary coded signal, the serialized function code B-1 is applied via signal line 42 to a function code decoder 44. The function code decoder 44 receives the serialized pulse code signal B-1 and produces a parallel binary coded output signal on signal line 46, this signal remaining unchanged or static until such time as there is a change in the input signal thereto at which time the parallel binary coded output signal therefrom changes state. This occurs when the function switch 22 is moved or the microphone switch is depressed.

The parallel coded signal on line 46 is then applied to a control circuit 48. The control circuit 48, as will be explained in detail below, produces a plurality of control signals which are applied to a ramp select circuit 50 via signal line 52, the ramp select circuit 50 in turn controlling a multifunction ramp generator 54. The ramp generator 54 produces a selected one of a plurality of time variable voltage curves (FIG. 2*c*). These various voltage curves are applied via signal line 56 to a variable frequency voltage controlled oscillator (VCO) 58. The VCO 58 produces a variable frequency output signal at its output 59, the frequency of the output signal being directly proportional to the envelope of the voltage applied to the VCO 58 by ramp generator 54. This variable frequency signal is then applied through a squaring circuit and buffer 60 to condition the signal to a power amplifier 64 via signal line 65, power amplifier 64 (FIG. 4) being adapted to provide maximum efficiency in the production of the siren signal as described in more detail in U.S. Pat. No. 4,189,718 above-identified. The output from the power amplifier 64 is applied to a loud speaker 66 to produce the actual audio siren, P.A., etc. sounds.

When the siren is being operated in a manual mode, that is, the mode in which the operator can control the frequency of the siren, it is possible for the operating frequency of the voltage controlled oscillator 58 to become too low in the sense that the low frequency of the signal can, at the high power levels available, cause damage to the speaker 66. Correspondingly, a frequency detector circuit 68 is provided, the frequency detector being connected to VCO 58 to sense the frequency of the signal being generated thereby. In the event that the signal frequency becomes too low, the frequency detector circuit 68 will apply a disabling signal to the control circuit 48 to automatically disable an incoming control signal.

It is also possible for the vehicle voltage level, normally 12 volts, to become too high. Accordingly, a high voltage protection circuit 74 is provided. The high voltage circuit 74 is connected to the vehicle power supply 19 and to the function code decoder 44. If the vehicle voltage level should exceed a safe limit, for example 16½ volts, the high voltage protection circuit 74 automatically disables the function code decoder 44 to block the control signals and disable the siren circuit.

When the siren is being used either as a public address amplifier or as a radio repeating device, it is necessary to sense this fact and alter the biasing of the power amplifier 64 to change its operational state from a Class B to a Class AB amplifier. This is effected by means of a P.A. mode detector circuit 76 which is coupled to the input circuit 40 to detect the presence of an intelligible audio signal on control line 14. The public address mode detector circuit 76 in turn controls a P.A. input switch 78 which will couple the audio signal via a signal line 80 to the power amplifier 64. Simultaneously, upon detecting an audio signal, a bias switch 82 operatively connected to P.A. mode detector 76 will automatically alter the biasing of the power amplifier 64 via signal line 83 to condition it for proper operation in an audio mode.

The radio input circuit and switch 84 are operated in response to reception of an appropriate signal from control circuit 48 to connect the vehicle's two-way radio communication system via input lines 85 to the power amplifier. Simultaneously bias switch 82 will respond to this same signal to condition the amplifier for audio amplification. Bias switch 82 is further responsive to an "off" state of the control head circuit 10 to automatically alter biasing of the power amplifier 64 to a low power consumption operating condition. Accordingly, the receiver circuit 12, while it remains operational at all times, will be conditioned to place a very small power load on the vehicle's electrical system when the control head is turned "off" thereby obviating the need for separate on/off switch on the power amplifier 12 which would have to be manually operated by an operator, a function which can be difficult in the event that the receiver 12 is mounted in a position such as the trunk of the vehicle.

The control circuit 48 and ramp select circuit 50 are responsive to a power on-reset control circuit 86 which is coupled directly to the input circuit 40 and provides for proper initialization of the control and ramp select circuits 48 and 50.

The specific circuits will now be described in more detail with particular reference to FIGS. 3 and 4*a*, 4*b*, and 4*c*.

Control Head

The control head 10 (FIG. 3) includes its own internal power supply 16 which has input terminals 19 connected to a motor vehicle's standard 12 volt D.C. power source (not shown). The vehicle's 12 volts D.C. power is applied through an on/off switch 92 through an isolation diode 94, and is used directly as a non-regulated 12 volt supply 96, and simultaneously is filtered via capacitor 98 and applied to the input of an integrated circuit voltage regulator 100. The output of voltage regulator 100 appears at terminal 102, where it is filtered by another capacitor 104, as a regulated 5 volt D.C. power source at terminal 106. A light emitting diode 108 is connected to the 5 volt D.C. power terminal 106, diode 108 being connected to ground 101 through a current limiting resistor 110 to provide an indication that the power supply is operating. This source signal is indicated as graph "A" in FIG. 2*b*.

Manually operable function switch 22 is provided with a common rotor terminal 112 which is connected to the 5 volt D.C. power source terminal 106. Switch 22, in a specific embodiment is a six position switch having selectable output contacts 114, 116, 118, 120, 122, and 124. Individual ones of the terminals 114 through 124 are designated for production of the various siren functions, radio repeat, P.A., manual, wail, yelp, and two-tone, respectively. Terminals 114, 116, 118, 122, and 124 are each individually connected to ground by means of a respective pull-down resistor 126. Terminal 120 is unconnected. Thus configured, the terminals 114, 116, 118, 122, and 124 will be at a substantially zero or grounded voltage level when open and, when the switch rotor 112 is connected thereto, will be at the source voltage of 5 volts D.C. If the array of contacts 114 through 124 is viewed as a binary input word, with 5 volts being a logic one and zero volts (actually any level less than 2.5 volts) being logic zero, the output word from the switch 22 will be as shown in the following Table I. The particular function of each switch position is denominated in the left column corresponding to each of the binary words.

TABLE I

| Switch Contact | 114 | 116 | 118 | 120 | 122 | 124 |
|---|---|---|---|---|---|---|
| Radio Repeat | 1 | 0 | 0 | 0 | 0 | 0 |
| P.A. | 0 | 1 | 0 | 0 | 0 | 0 |
| Manual | 0 | 0 | 1 | 0 | 0 | 0 |
| Wail | 0 | 0 | 0 | 0 | 0 | 0 |
| Yelp | 0 | 0 | 0 | 0 | 1 | 0 |
| Two-tone | 0 | 0 | 0 | 0 | 0 | 1 |

This binary word is, in turn, applied through a logic circuit or function code control 24. The function code control 24 comprises a plurality or NOR logic gates 128, 130, 132, 134, and 136 and each will produce a logic one output in the absence of any logic one at their input terminals and will exhibit a logic zero output in response to a logic one input at either or by both input terminals. As configured in FIG. 3, the logical output of the function code control 24 will be as shown in Table II below, in which the outputs of the NOR gates 128, 130, and 132 are designated as X, Y, and Z. W in Table II denotes the auxiliary circuit operating state and may assume alternate states for each switch 22 position except Radio Repeat, one row indicating the logic states when the auxiliary circuit is active and the adjacent row indicating the logic combinations when the auxiliary circuit is inactive.

TABLE II

| | X | Y | Z | W |
|---|---|---|---|---|
| Radio | 0 | 1 | 0 | 1 |
| Repeat | 0 | 1 | 0 | 1 |
| P.A. | 0 | 1 | 1 | 1 |
| | 0 | 1 | 1 | 0 |
| Manual | 1 | 1 | 0 | 1 |
| | 1 | 1 | 0 | 0 |
| Wail | 1 | 1 | 1 | 1 |
| | 1 | 1 | 1 | 0 |
| Yelp | 1 | 0 | 1 | 1 |
| | 1 | 0 | 1 | 0 |
| Two- | 1 | 0 | 0 | 1 |
| Tone | 1 | 0 | 0 | 0 |

This combination of binary signals will now be seen to comprise a plurality of parallel binary coded function signals which are applied to the parallel input terminals 137 of an integrated circuit encoder 135. In a specific working embodiment, the encoder used is a Motorola MC145026 encoder and the outputs X, Y, Z from NOR gates 128, 130, and 132 are applied to data terminals "9", "7", and "6" thereof, respectively.

The encoder 135 is provided as one half of an encoder, decoder set, this encoder-decoder pair being described in detail in Motorola Semi-Conductors Advance Information Bulletin ADI-855 for MC145026 encoders and MC145027/MC145028 decoders.

Functionally, the encoder has a resistor/capacitor network indicated generally as 136 connected thereto to condition an internal clock oscillator of the encoder circuit 135 for operation at a predetermined frequency. Encoder 135 is connected by a terminal 138 to the 5 volt regulated power source.

The encoder circuit 135 has an input terminal 140 (pin "14" of the MC145026) which is an enabling input. When this input is maintained at a logic 1, the circuit 135 is disabled and when this pin is at a logic zero (below 2.5 volts) the circuit is enabled and commences to operate. To insure that circuit 135 will have adequate time to stabilize, terminal 138 is connected to the 5 volt regulated supply 106 across a capacitor 144, the opposite terminal of capacitor 144 being connected through a resistor 146 to ground (same as 101 and which appears at the output terminal 148 of a NOR gate 160). Accordingly, when the power switch 92 is initially turned "on" (see graph "A" of FIG. 2*b*), the +5 volts or logic one is applied to terminal 140 maintaining the encoder inactive. As this voltage disappears, as a result of charging of capacitor 144 the disabling signal at terminal 140 eventually reaches what is effectively a logic zero state (below 2.5 volts) and the encoder commences to operate. This is shown in graph "C" of FIG. 2*b*.

Another data input terminal 149 of encoder 135 is connected through resistor 150 to the auxiliary circuit 45 and through a blocking diode 152 connected between the "radio repeat" terminal 114 of switch 22 and terminal 149. This circuitry functions to input a logic signal representing the operating state ("on" "off") of the auxiliary circuit 45. This data bit is indicated as "W" in Table II, and on FIG. 3, a logic 1 appearing when the auxiliary circuit is "off". Diode 152 causes a logic one to be applied to input 149 (W) at all times when switch 22 is in the Radio Repeat position while permitting this input to change in all other switch positions.

When the encoder 135 has been appropriately activated, it will produce a sequentially occurring, serial coded pulse signal or pulse train at its output terminal 156 (terminal "15" of the MC145026) which corresponds to or is otherwise determined by parallel binary coded function switch signal applied to its input terminals 137 and 149. This serialized binary coded output signal or pulse train is illustrated diagrammatically in FIG. 2*a* which is the same as portion "B-1" of graph "B", FIG. 2*b*. As described in the previously referenced Motorola Semi-Conductor Advance Information Bulletin, the encoder chip actually has a capability of transmitting in excess of 19,000 different codes. This is accomplished by utilizing four data inputs and five address inputs 158. Each output pulse can assume a logic one, a logic zero, or an "open" state. "Open" states (trinary states) are not used herein and should be ignored. Each bit is represented by pulses as shown in the waveform in FIG. 2*a* which may be decoded either "one" (5 volts) or "zero" (less than 2.5 volts) as at "a"

and "b". The "short" pulses are timing signals and do not register as data bits. In the present invention, only six specific codes plus an auxiliary over-ride signal (Table II) are required. Similarly, the address input terminals 158 of the encoder 135 are simply set permanently 00000 by connecting them to ground 101.

When it is desired to utilize the invention as a P.A. device, it is necessary to disable the encoder 135 so that it will not attempt to transmit a siren control code over the control line 32. This is accomplished by NOR gate 160 which has its output terminal 148 connected through a diode 162 to the enabling input terminal 140 of the encoder 135. The input terminals 164 of gate 160 are connected in common to an output terminal 166 of microphone switch 168. The other terminal of switch 168 is connected directly to ground 101. Accordingly, when switch 168 is depressed, closing the normally open contacts 168 thereof, the input terminals 164 of gate 160 are placed at logic zero. Alternately, when the switch is released, the input terminals 164 are placed at plus 5 volts or logic one by reason of the connection thereof through a pull-up resistor 172 connected between the terminals 164 and the 5 volt power source 106. Because gate 160 is a NOR gate, closing of switch 168 will result in a logic one appearing at its output terminal 148. This logic one signal is in turn passed via diode 162 to the enabling terminal 140 of encoder 135. This occurs almost instantaneously due to the low forward gain of diode 162 which eliminates the delay that would otherwise occur if the signal were to pass through resistor 146. This logic one signal therefore instantaneously renders encoder 135 disabled thereby terminating the transmission of the siren code signals. This is indicated by point $C_1$ in graph "C" in FIG. 2*b*, graph "D" showing the state of microphone switch 168.

Simultaneously, closure of switch 168 connects the microphone, a high gain amplifier microphone in a working embodiment, through a resistor 192 and a volume control rheostat 184 to the base 186 of a PNP transistor 188, connected in a common collector configuration.

The transistor 188 functions primarily as an impedance matching device to match the microphone impedance with that of the amplifier circuit 12 described below.

For a reason to be explained in more detail below in reference to the receiver circuit 12, it is necessary that the audio signal generated by circuit portion 34 have an average voltage level of plus 5.7 volts while simultaneously being limited to about 2 volts maximum signal swing peak to peak. This is accomplished by connecting the base of transistor 188 to the +5 VDC service through a resistor 190 and rheostat 184, one end of rheostat 184 being connected to the plus 5 volt source 106. The emitter 196 of transistor 188 is effectively connected to transformer terminal 462 (FIG. 4*c*) in the power amplifier. Under the conditions that rheostat 184 is adjusted for maximum resistance, base 186 will be coupled almost directly to +5 VDC by rheostat 184. Base 186 will be operating at about 5 volts D.C. Because of the common collector configuration of transistor 188, the emitter 196 thereof will therefore tend to follow the voltage at base 186 plus about 0.7 volts D.C. This is, of course, the required 5.7 volt average signal. If the rheostat 184 is adjusted to its opposite extreme, the bias conditions on transistor 188 will remain substantially the same. Further, in the event that the impedance of the microphone should drop significantly, as would occur when an operator is speaking into it, the "flyback" characteristic of the transformer in the power amplifier (described below) will resist the tendency of the biasing conditions on transistor 188 to change. That is, the transformer will tend to maintain the bias voltage at base 186 at its 5 volt D.C. level by reason of the transformer driving the emitter 196 of the transistor 188 in a direction to resist a voltage drop. Simultaneously, it will be seen that because of the inherent limited emitter-base voltage drop when transistor 188 is conducting, the tendency to raise the base voltage in the presence of the flyback effect produced by the transformer is eliminated and this circuit is still maintained at the average 5.7 volt D.C. operating condition required. The peak to peak voltage is controlled by the relative values of rheostat 184, the specific operating characteristic of the microphone 38, and series resistor 192.

The output from the microphone circuit appears at emitter 196 and is passed via a current limiting resistor 200 to the control line 32. Resistor 200 is placed in the circuit as a protective device for transistor 188, which could be destroyed in the event that control line 14 should accidentally come in contact with a full 12 volt D.C. source during installation or the like. The P.A. signal is shown at B-2 in FIG. 2*b*.

Next, in the control circuit there is included an auxiliary circuit indicated generally at 45, which is substantially the same as disclosed in U.S. Pat. No. 4,189,718. The auxiliary circuit 45 has an input terminal 204 which is adapted to be connected to the horn ring or the like of a vehicle. As explained in detail in U.S. Pat. No. 4,189,718 previously identified, this circuit provides auxiliary input capabilities such as the capability of producing electronically a simulated air horn sound. Circuit 45 includes a voltage divider comprising diode 206 and resistors 208, 210, and 212 connected between the source 106 and ground 101. The signal at the common connection 209 of diode 206 and resistor 208 is applied simultaneously to both input terminals 211 of a NOR gate 213. The output of NOR gate 213 is in turn applied to one input terminal 214 of another NOR gate 216.

Terminal 209 is connected to the auxiliary input through a parallel resistor-diode network including resistors 220 and 223 and diode 222. Diode 228 has its cathode connected to terminal 209 of a momentary normally open switch connected between terminal 209 and ground. A filter capacitor 236 is also connected between terminal 209 and ground 101. In operation, the auxiliary circuit operates substantially identically to that described in U.S. Pat. No. 4,189,718 above identified. For purposes of the present disclosure it is sufficient to note that the output from this circuit appearing at NOR gate output terminal 217 is applied to terminal 149 of encoder 135 as a fourth input bit, this being indicated as input W in Table II.

The control head 10 also includes the buffer amplifier 30 comprising transistor 240 connected in a common emitter configuration and having its base 242 connected through a base resistor 244 to receive the output signal from the encoder 135 output terminal 156. The collector of transistor 240 is connected to the 12 volt supply 96 via a load resistor 248. The buffer amplifier boosts the relatively low power output signal from the encoder. As connected, transistor 240 functions primarily as an inverting switch and an amplifier which in effect duplicates and amplifies the serial pulse code signal from the output terminal 156 of the encoder 135. A filter capacitor 250 is connected between the encoder transmission line 32 and ground to eliminate extraneous signals, noise and the like.

Receiver Circuit

Terminal 251 (FIG. 4*a*) is connected to terminal 14 (FIG. 3) of the control line 32 which may be a single conductor wire of any reasonable length. When the control switch 22 is in a position to command a siren signal, the coded signal will be appearing across a voltage divider comprising resistors 252, 254 as a series of twelve volt pulses. Resistor 256 is again utilized as a current limiting device to protect the circuit in the case of an inadvertent shorting of control line 32 and as part of a filter which includes capacitor 258. The common terminal 261 of resistors 252 and 254 is connected to the base of an NPN transistor 262 connected in a common emitter configuration and having its collector 264 coupled to a plus 8 volt D.C. supply source (described below) through resistor 266. Thus configured, transistor 262 will function as an amplifier and inverter. Each logic one pulse (portion B-1 of FIG. 2*b*) will toggle transistor 262 "on" and logic zero signals will render transistor 262 "off" thereby producing an inverted signal at collector 264 resulting in restoration of the control signal polarity as indicated by waveform "E" in FIG. 2*b*. These sequentially occurring pulses are the serial coded pulse signal shown in expanded detail in FIG. 2*a* and the inversion thereof, respectively. This signal is in turn, applied to an input terminal 268 of a decoder circuit 270 to be described in more detail below.

Alternatively, when the microphone switch 168 (FIG. 3) is depressed it will be recalled that the audio signal (curve section B-2 in FIG. 2*b*) is applied to the base of transistor 262. The signal is divided by the resistor network 252, 254 and, accordingly, transistor 262 will be rendered "on". This effectively produces a low voltage at collector 264 which is the equivalent of a logic zero signal.

Recalling that the control line 32, carries either the inverted control data originally generated by encoder 135 or an intelligible audio signal from microphone 38, it will be recognized that the first function that must be performed by the receiver 12 is to distinguish between these two signals and, therefore, to condition the receiver 12 to distinguish between these two signals. This is, in combination, effected by the input circuit 40 (FIG. 1 and 4*a*), and the P.A. mode detector 76. The siren signal pulses appearing at terminal 260 are essentially of 12 volts magnitude and, by reason of the voltage divider comprising resistors 252, 254, has a voltage value of about 6 volts at the base of transistor 262 which is sufficient to trigger transistor 262 between conductive and non-conductive states. Accordingly, when there is a data signal appearing at terminal 260, the output from transistor 262 appearing at its collector 264 will be a closely spaced series of positive going pulses of about 8 volts peak to peak magnitude (Graph E, FIG. 2*b*).

These siren pulses are applied via signal line 271 through a diode 272 having its anode connected to collector 264 and its cathode connected to an RC network comprising resistor 274 and capacitor 276, the opposite ends of resistor 274 and capacitor 276 being coupled to ground. The cathode end of diode 272 is further connected to the input terminals 278 of a NOR gate 280. The output terminal 282 of gate 280 is applied through an inverter 284 and resistor 286 to the base 288 of a PNP transistor 290. The emitter 292 of transistor 290 is connected to a resistor 294, the output of this circuit appearing at terminal 296.

The collector 298 of transistor 290 is coupled through the emitter-collector circuit 300 of a second PNP transistor 302 to ground 101. The base 304 of transistor 302 is coupled through a resistor 306 to terminal 260.

Thus configured, when the input terminal 260 is receiving the siren data pulses corresponding to a siren signal, the signal will switch transistor 262 between conductive and non-conductive states thereby effectively producing a series of sequentially occurring positive pulses on line 271. These signals are passed by diode 272 to the resistor capacitor network 276, 274. The discharge rate of capacitor 276 is controlled by resistor 274, diode 272 being reverse biased and acting as a blocking diode whenever transistor 262 is conductive. Since this pulse signal will have an amplitude of about 8 volts (the source voltage applied to its collector), this results effectively in the application of a logic one signal to the input terminals 278 of NOR gate 280, resulting in a logic zero signal at the output terminal 282 thereof. This produces a logic one signal through inverter 284 which is applied to base 288 of transistor 290. Since the emitter 292 of transistor 290 is coupled through the power amplifier transformer lead 462 to a 8 VDC source, this results in reverse biasing of transistor 290 rendering it "off" in the presence of the encoded siren signals. If the microphone button 168 is depressed, the average plus 5.7 VDC signal (B-2, FIG. 2*b*) appears at terminal 260 and will forward bias transistor 262 rendering it "on" and producing a logic zero signal on line 271. This logic zero signal reverse biases diode 272 permitting capacitor 276 to totally discharge. Accordingly, a logic zero signal is applied to the input terminals 278 of NOR gate 280. This results in a logic one signal at output terminal 282, producing a logic zero signal output from inverter 284. Since a logic zero is essentially a zero volt signal, this will render transistor 290 conductive. Simultaneously, the +5.7 VDC audio signal is applied via signal line 310 to the base 304 of transistor 302. This results in forward biasing of this transistor thereby producing linear operation of transistor 302 which now acts as a buffer amplifier for the intelligible audio signal appearing at base 304. This signal, because transistor 290 is in a conductive state, is applied to the output terminal 296 and to the power amplifier described below.

In order to avoid noise during transition states from either siren modes or to a P.A. mode, it will be observed that a capacitor 276 and resistor 274 will produce a time delay in the transition or switching of NOR gate 280. When the circuit switches into a siren mode, for example, a short but discrete period of time is required for capacitor 276 to accumulate a sufficient charge to apply a logic one signal to input terminals 278 of NOR gate 280. Conversely, when the microphone switch is depressed, the same short but discrete period of time is required for capacitor 276 to fully discharge to apply a logic zero signal to the NOR gate 280. Both of these time delays will effectively delay the appearance of either control signals or audio signals passing through the transistor 290 until the circuit has had an opportunity to stabilize. Simultaneously, because transistor 302 is connected to the input terminal through a purely resistive network, it will respond instantaneously to either the siren signal or audio signal on line 310. Accordingly, transistor 302 will function before operation of transistor 290, this sequence being necessary to assure proper "on/off" switching of the transistor 290. Accordingly, it will be seen that the P.A. input switch circuit 78 senses and responds to the presence of the audio signal at terminal 260 to couple the signals appearing at terminal 260 to output terminal 296 of the P.A. input switch 78, this transition being effected without the transmission of noise or extraneous signals during the transition state.

Decoder Circuit

Figure 4A:
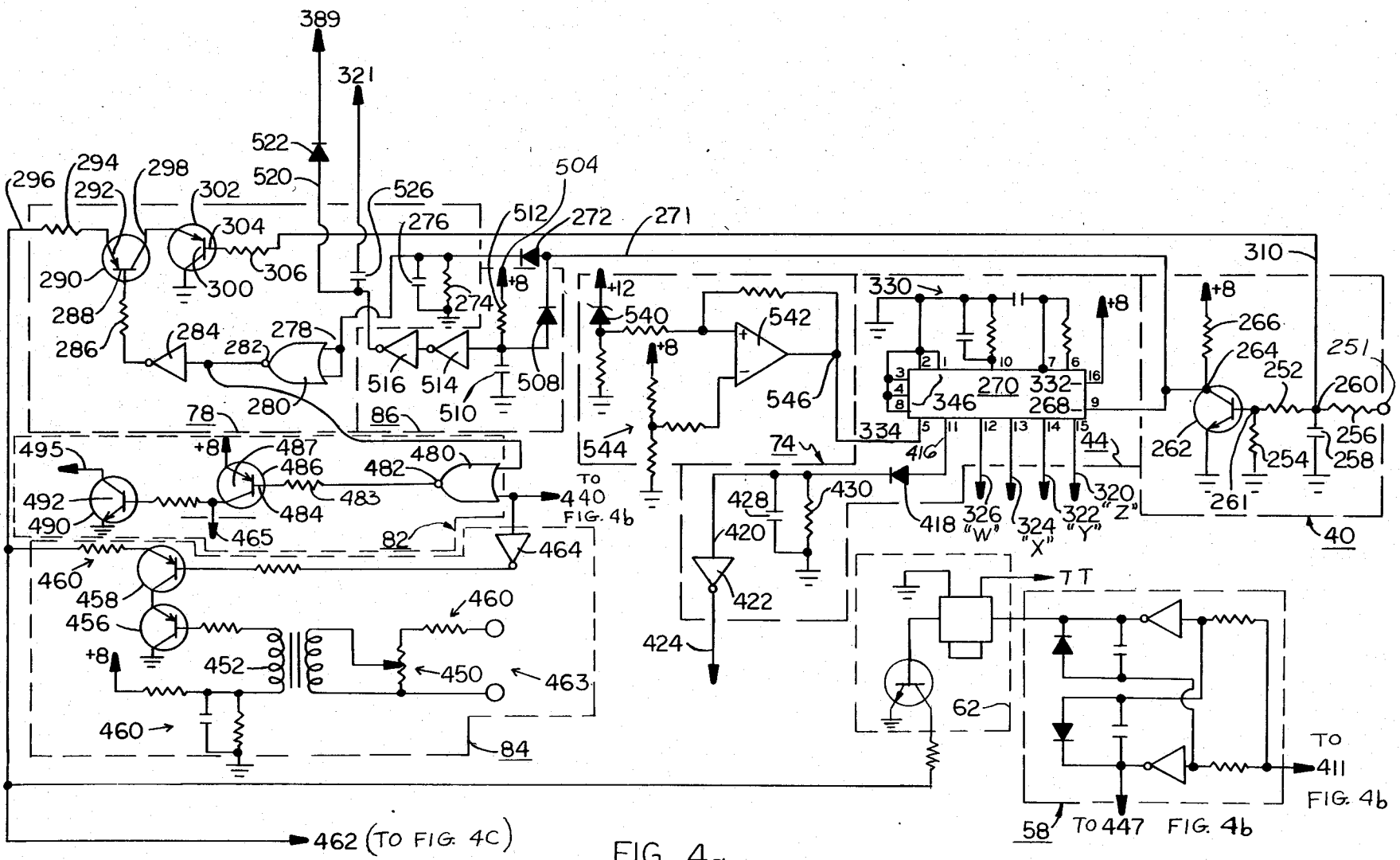

The function code decoder 44 (FIG. 4*a*) comprises basically a binary serial input/parallel output device for receiving serialized siren input control signals (pulses) at its input terminal 268 and converting these signals into a corresponding static parallel output signals at a plurality of output terminals 320, 322, 324, and 326 (FIG. 4*a*). In a working embodiment of the invention, this device can be provided in the form of a single micro-circuit of the CMOS MSI type manufactured by Motorola Semiconductors as an MC145027 decoder, a detailed description of the function of this circuit and the proper external elements required for its operation being fully described in Motorola Semi-Conductors Advanced Information Bulletin ADI-855. The external components include a resistor-capacitor network indicated generally at 330 which establishes the operating frequency of the device, a power input terminal 332, an output terminal 416 which indicates the presence or absence of a valid transmission, and a plurality of address signal input terminals 346. It will be observed that all of the terminals 346 are grounded as were all of the address signal terminals 158 of the encoder chip 135 in circuit 34. Terminal 334 is not grounded, but is maintained at a logic "0" level during normal operation. Accordingly, it will be seen that the address input to encoder chip 135 will correspond to the same address actually applied to the address input terminals 346, it being found in the present circuit that the transmission of an address code is unnecessary and it is accordingly only necessary that the two address codes agree. In the following Table III there are listed the parallel binary coded output appearing at terminals 320 through 326, which basically comprise a four (4) bit binary word. It will now be seen that there is a different static parallel output code for each of the available parallel binary coded function signals resulting from the switch positions of switch 22 and the operating state of the auxiliary circuit, these outputs again being denominated X, Y, Z, and W, the output W being for the auxiliary circuit.

TABLE III

| | Radio Repeat | P.A. | Man. | Wail | Yelp | Two-Tone |
|---|---|---|---|---|---|---|
| 270 PIN 326 (W) | 1 1 | 1 0 | 1 0 | 1 0 | 1 0 | 1 0 |
| 270 PIN 320 (Z) | 0 0 | 1 1 | 0 0 | 1 1 | 1 1 | 0 0 |
| 270 PIN 322 (Y) | 1 1 | 1 1 | 1 1 | 1 1 | 0 0 | 0 0 |
| 270 PIN 324 (X) | 0 0 | 0 0 | 1 1 | 1 1 | 1 1 | 1 1 |
| 270 PIN 416 VALID TRANS. | 1 1 | 1 1 | 1 1 | 1 1 | 1 1 | 1 1 |

Control Circuit

Figure 4B:
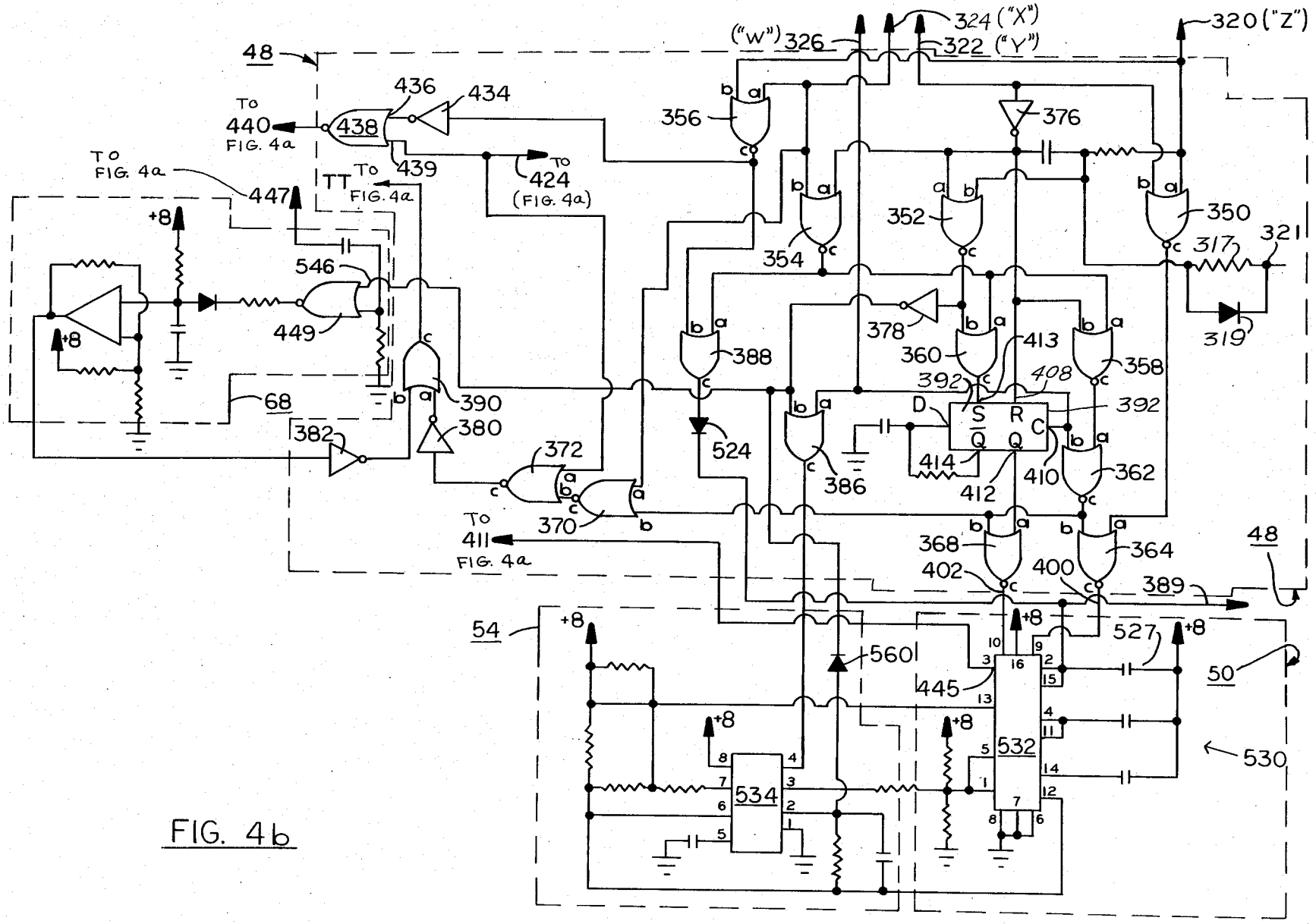
Figure 4C:
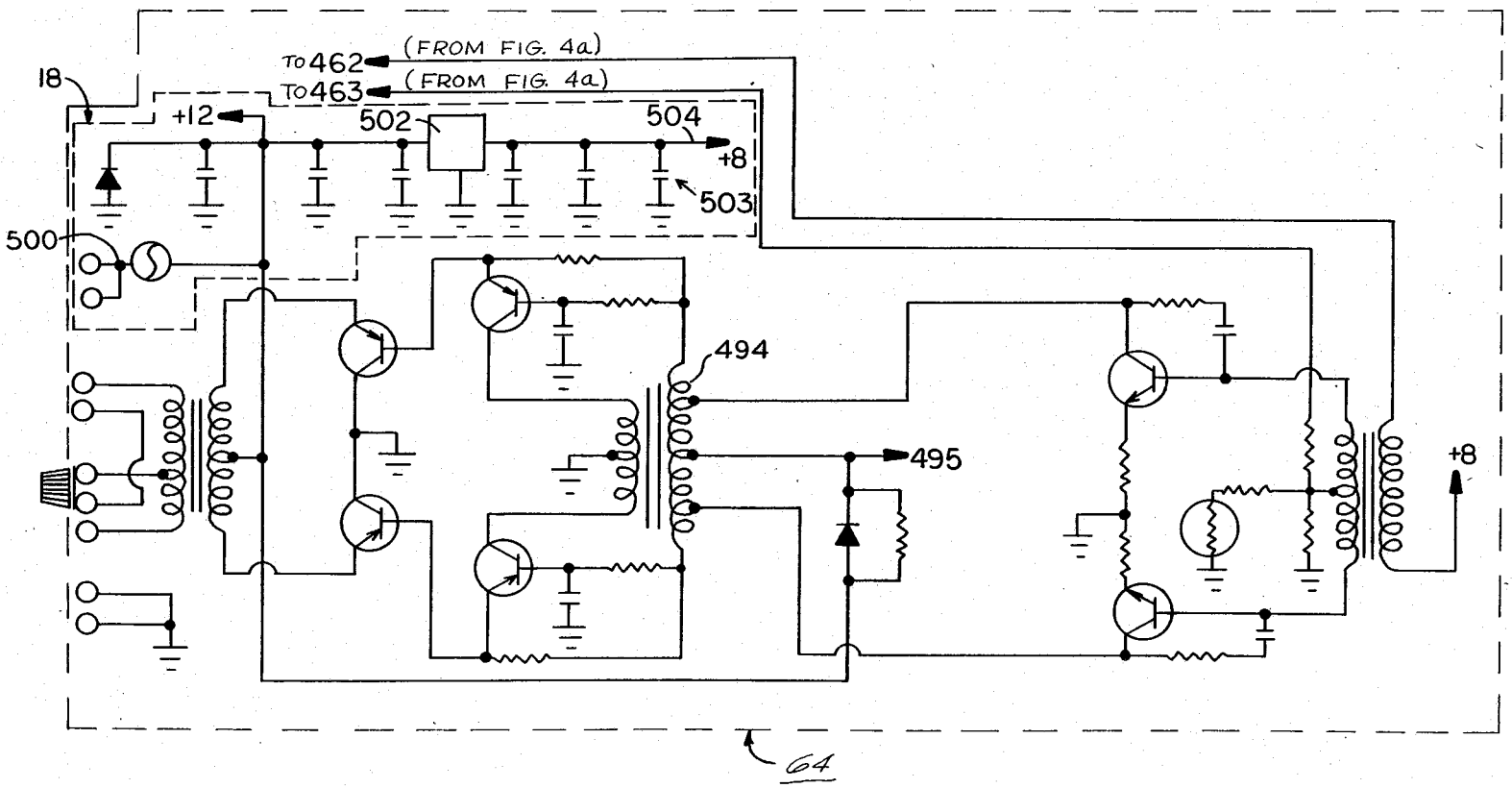

This binary word is applied to the input of the control circuit 48 in FIG. 4*b*. The control circuit 48 can be viewed as having four inputs via the conductors 320, 322, 324, and 326, which are applied to a logic circuit comprising NOR gates 350, 352, 354, 356, 358, 362, 364, 368, 370, and 372; inverters 376, 378, 380, and 382; and OR gates 360, 386, 388, 390; and RS flip-flop 392. In over all function, the control circuit 48 has a pair of output terminals 400, 402 which apply a two bit binary coded signal to a ramp select circuit 50. These two outputs 400, 402 corresponding to flow line 52 of FIG. 1. It is the outputs appearing at terminals 400, 402 which control a ramp selecting circuit 50 which in turn controls a ramp signal generator 54. This portion of the circuit is substantially identical to that described in U.S. Pat. No. 4,189,718, and accordingly, a detailed description of the ramp selecting circuit 50 and the voltage control oscillator 58 (FIG. 4*a*) are unnecessary herein beyond a brief description required for clarity.

The control circuit 48 basically functions as a logic circuit for converting the four bit binary input signal from the decoder 270 into the necessary two bit control signal for controlling the ramp select circuit 50 or, alternatively, conditioning the receiver circuit 12 to function in a public address mode, radio repeat mode, or manual mode. Additionally, control circuit 48 will provide a logical determination of and resulting signals for controlling the operation of a frequency detector 68, a radio input and switch circuit 84, bias switch 82 and controlling the operation of a squaring circuit and buffer 62.

The control signal circuit can be best understood by tracing the logical sequence of signals therethrough in a specific example. Assume that the decoder 270 has received a signal from the control head to establish two-tone operation. Under these circumstances, and denoting the signals outputed by terminals 326, 320, 322, 324, as W, Z, Y, and X, respectively, and assuming that the auxiliary input is inactive the signal will have logic states 1001, respectively. This applies a logic zero signal to input terminal 350-*a* and logic zero to terminal 350-*b*. This results in an output signal of logic one at terminal 350-*c*. The logic zero on 350-*b* also appears at the input of inverter 376 producing a logic one output which results in a logic one input to the reset terminal 408 of flip-flop 392. The output of inverter 376 also applies a logic one input to terminals 352-*a*, 354-*a* and 358-*b*. Terminal 352-*b* is at logic zero, being connected to receive input Z. Being connected to receive input X, terminal 354-*b* is at logic one as is terminal 370-*a* connected thereto. This produces a logic zero at terminal 352-*c* and 354-*c*. NOR gate 356 has input signals of logic one at terminal 356-*a*, and logic zero at 356-*b* producing a logic zero at terminal 356-*c*. This, in turn, results in logic inputs of zero and one on terminals 358-*a*, 358-*b*, respectively and zero, at terminals 388-*a* and 388-*b*, respectively. Terminals 360-*a* and 360-*b* are similarly at logic zero, zero, respectively, to produce logic outputs of zero, zero, and zero at output terminals 358-*c*, 360-*c*, and 388-*c*.

The inputs to NOR gate 362 will be at logic zero and one at terminals 362-*a* and 362-*b*. Clock input terminal 410 of flip-flop 392 will also be at logic one. This will result in a logic zero signal appearing at the "Q" output terminal 412 of flip-flop 392 and a logic one output at the "$\overline{Q}$" terminal 414. The logic input to terminals 386-*a* and 386-*b* will be at logic one, one respectively. This produces logic outputs of zero at 362-*c* and one at 386-*c*. A logic zero to terminals 364-*b*, 368-*b*, and 370-*b* while the logic signals at terminals 364-*a*, 368-*a*, and 370-*a* will be one, zero, and one, respectively. This in turn results in a logic output of zero, one, at output terminals 400-*c* and 402-*c*.

Simultaneously, terminal 416 (FIG. 4*a*) of the decoder circuit 270 is at logic one, this being the valid address output terminal and all of the address terminals 346 being grounded to provide a valid address indication at all times. This logic one signal passes through a blocking diode 418 to input terminal 420 of an inverter 422 producing a logic zero signal at terminal 424 which appears as a logic zero signal at terminal 372-*a*. Terminal 372-*b* is at logic zero thereby producing a logic one at terminal 372-*c*.

Capacitor 428 and resistor 430 (FIG. 4*a*), are connected between terminal 416 of decoder 270 and ground 101 and produce a delay in the response of the valid address output signal which prevents inadvertent operation of the logic circuitry when the mode selector switch is being moved. That is, capacitor 428 and resistor 430 become charged in response to the valid transmission signal and this signal is maintained for a brief period of time after termination of a valid address signal by the resistor capacitor circuit which allows sufficient time for the mode selector switch to be moved before the valid transmission signal will disappear.

The logic one signal appearing at terminal 372-*c* is converted to a logic zero signal by inverter 380 which is applied to terminal 390-*a*. Since gate 390 is an OR gate, this produces a logic zero signal at its output 390-*c* assuming for the moment that the signal at terminal 390-*b* is also at zero. Note that terminal 390-*b* will change to a logic one signal in response to operation of the frequency detector circuit 68 described in more detail below. The logic zero output at terminal 390-*c* is outputed to the squaring circuit and buffer 62, also described below.

Other signals appearing under these operating conditions are a logic zero signal at the input of inverter 434 to apply a logic one signal to terminal 436 of NOR gate 438. The other input 439 of OR gate 438 is coupled to the output of inverter 422 through terminals 424 and accordingly is at logic zero resulting in a logic zero signal at terminal 440 which is used as described below, to control operation of the bias switch 82 and radio input and switch 84. From the above description it will now be seen that the application of a particular combination of logic signals generated by the decoder circuit 270 produces a specific combination of output signals from the control circuit which are applied to various parts of the receiver circuit such as the ramp select circuit 50, frequency detector 68, and the like to effect proper operation. A complete truth table showing the logic states of significant ones of the gates in the control circuit are listed below in Table IV and will enable similar tracing of the logic sequence of the control circuit for each possible input state to decoder 270. In this table, there are two sets of logic states given for each of the mode switch positions, one column indicating the logic states when the auxiliary input circuit is active and the other column indicating the logic combinations when the auxiliary input circuit is inactive.

TABLE IV

| | | | | Radio Repeat | P.A. | MAN. | WAIL | YELP | TONE |
|---|---|---|---|---|---|---|---|---|---|
| 392 | PIN | 408 | RESET | 0 0 | 0 0 | 0 0 | 0 0 | 1 1 | 1 1 |
| 392 | PIN | 413 | SET | 1 1 | 1 1 | 1 1 | 0 0 | 0 0 | 0 0 |
| 392 | PIN | 412 | Q OUTPUT | 1 1 | 1 1 | 1 1 | a a | 0 0 | 0 0 |
| 358 | PIN | C | (0=A.H.ENABLE) | 0 0 | 0 0 | 1 1 | 1 1 | 0 0 | 0 0 |
| 392 | PIN | 410 | CLOCK INPUT | 1 1 | 1 0 | 1 0 | 1 0 | 1 0 | 1 0 |
| 532 | PIN | 9* | RAMP SELECT B | 1 1 | 1 0 | 1 1 | 1 1 | 1 0 | 0 0 |
| 532 | PIN | 10* | RAMP SELECT A | 0 0 | 0 0 | 0 0 | b b | 1 0 | 1 0 |
| 280 | PIN | 282 | P.A. SWITCH | 0 0 | 0 0 | 0 0 | 0 0 | 0 0 | 0 0 |
| 438 | PIN | Out | RAD. SWITCH | 1 1 | 0 0 | 0 0 | 0 0 | 0 0 | 0 0 |
| 390 | PIN | Out | (0=SIREN ENABLE) | 1 1 | 1 0 | 1 0 | 0 0 | 0 0 | 0 0 |
| 480 | PIN | 482 | (0=BIAS SW. ON) | 0 0 | 1 1 | 1 1 | 1 1 | 1 1 | 1 1 |
| 449 | PIN | 546 | (0=FREQ.DET.ON) | 0 0 | 1 1 | 0 0 | 1 1 | 1 1 | 1 1 |
| 534 | PIN | 4* | (0=RAMP GEN.RST) | 1 1 | 1 1 | 1 0 | 1 1 | 1 1 | 1 1 |
| 560 | CATH. | | (0=RAMP GEN.HOLD) | 0 0 | 1 1 | 0 0 | 1 1 | 1 1 | 1 1 |

*Pin number is manufacturer's pin number
a = 1 FOR WAIL TONE, a = 0 FOR YELP TONE
b = INVERSE OF a

Ramp Select and Ramp Generator

The ramp select circuit 50 and ramp generator 54 utilized in the present invention are substantially identical to those disclosed in U.S. Pat. No. 4,189,718 and accordingly, a detailed description thereof is not required. For the present disclosure, however, it should be noted that the ramp select and ramp generator circuit incorporates a plurality of capacitors 530 connected through ramp selecting micro circuit 532 to a ramp generating circuit 534 to produce a plurality of wave forms, these wave forms being indicated in FIG. 2*c*, derived from said U.S. patent, a specific one of these ramp functions being produced in response to specific ones of the combination of signals appearing at terminals 400, 402.

The Voltage Control Oscillator and Power Amplifier

The voltage controlled oscillator (FIG. 4*a*) 58 of the present invention is also substantially identical to that described in U.S. Pat. No. 4,189,718 as is the squaring circuit and buffer 60. The input and output from the squaring circuit and buffer are indicated in FIG. 2*c* as charts E and G and the logic state controlling this output is also indicated in logic Table IV. The power amplifier 64 (FIG. 4*c*) is the same as that disclosed in the above identified U.S. patent and produces a high power signal to the speaker 66 as disclosed therein.

Radio Input and Switch

This circuit 84 (FIG. 4*a*) controls the application of a vehicle's two way radio receiver output to the siren power amplifier 64. This circuit is responsive to the logic signal appearing at the output of NOR gate 438 (FIG. 4*b*). The radio input switch is basically a transformer coupled amplifier including a volume control rheostat 450 (FIG. 4*a*), isolation transformer 452, and a transistor amplifier including transistors 456, 458 connected as an emitter follower and switch, respectively. Appropriate biasing and filter resistors are provided as at 460, and the output of the radio input and switch circuit 84 is applied to the input signal line 462 (FIG. 4*a*, 4*b*) of the power amplifier 64. The vehicle's radio output, applied to terminals 463 (FIG. 4*a*) will be passed to the power amplifier in response to the logic signal applied to inverter 464 (FIG. 4*a*), coupled to the output terminal 440 of NOR gate 438 (FIG. 4*b*), the radio input and switch 84 being active to pass radio signals whenever the output of inverter 464 is at logic zero and to block these signals otherwise. From Table IV it will be seen that this occurs when the mode selector switch 22 is in the radio repeat mode.

Frequency Detector

The frequency detector circuit 68 (FIG. 4*b*) is also substantially identical to that described in U.S. Pat. No. 4,189,718. Briefly, the frequency detector circuit responds to logic signals as indicated in Table IV and the frequency of the signal generated by the voltage controlled oscillator 58. The circuit parameters are selected to toggle OR gate 390 to a logic one which results in blocking the output of voltage controlled oscillator 58 whenever the receiver circuit is operating in the manual mode and the frequency of the signal generated thereby drops, as sensed via signal line 447 to NOR gate 449, to a level that would cause a VCO frequency below about 400 cycles per second to thereby avoid damage that can occur to the speaker of the siren as a result of too low an output frequency.

Bias Switch

Since in the present invention, the entire receiver circuit 12 is designed to be mounted in a remote location in the vehicle, such as for example, in the trunk thereof, it is impractical for an operator to have to go to the remote location to turn the receiver circuit 12 "on" or "off". It is similarly impractical to place an additional "on/off" switch in a convenient location near the dashboard of the vehicle, this requiring additional wiring, a switch, space and the like. Nonetheless, when the receiver circuit 12 is in its normal operating state, it draws a significant amount of current when it is operating, this current being in the order of 250 milliamps. This much current load on a vehicle electrical system could substantially shorten battery life. Accordingly, the receiver 12 is provided with a bias switch 82 (FIG. 4*a*) which will automatically reduce the bias current of the power amplifier 64 (FIG. 4*c*) to a level of about 20 milliamps whenever the receiver 12 is not in use and is in a standby state. The bias switch 82 includes a NOR gate 480 (FIG. 4*a*) having its input terminals 423 connected to the output 282 of NOR gate 280 (FIG. 4*a*) and NOR gate 438 (FIG. 4*b*) in the P.A. mode detector and 76 control circuit, respectively. The logic states appearing at the inputs of NOR gate 480 are also indicated in Table IV and produce a logic signal at the output terminal 482 thereof as indicated in Table IV. This signal is in turn applied through resistor 483 to the base 484 of PNP transistor 486. The emitter-collector circuit 487 of transistor 486 is coupled between an 8 volt DC supply and a second control transistor 490. Transistor 490 in turn has its emitter-collector circuit 492 connected through the driver transformer 494 (FIG. 4*c*) of the power amplifier 64 to the power transistors (not labeled) of the power amplifier. Accordingly, when the bias switch 82 is rendered conductive, the bias currents provided for the power transistors of the power amplifier are at their normal state. Alternatively, whenever the circuit is rendered inactive corresponding to a logic one signal at terminal 482, transistors 486 and 490 are rendered nonconductive thereby substantially reducing the bias current applied through transformer winding 494 to the power transistors to a level of about 20 milliamps. This load level has found to have no significant affect on the vehicle electric system. When the logic signal at output 482 is at zero, the circuit 82 is rendered conductive restoring the high level biasing required for the power amplifier 64. This same circuit responds to the audio signal, P.A. detector, and control circuit to automatically produce class AB operation of the power amplifier when operating in P.A., and radio repeat modes.

Power Supply

The receiver 12 is provided with a separate power supply 18, this again being required due to its remote location from the control head. The power supply 18 includes an input terminal 500 (FIG. 4*c*) connected directly to the vehicle's 12 volt power supply, a conventional MOS/LSI micro-circuit voltage regulator 502, and a plurality of parallel connected capacitors 503 to filter out noise and to smooth the output voltages therefrom. Power supply 18 produces a regulated 8 volt D.C. power source at its output terminal 504 used throughout the receiver circuit 12.

Power On-Reset

This circuit shown in FIG. 4*a* is indicated generally at 86 and comprises a diode 508 having its cathode connected to signal line 271. The anode of diode 508 is connected to the common connection of a capacitor 510 and resistor 512, these being connected to the 8 volt D.C. source 504 and ground 101, respectively, and to the input of series connected inverters 514, 516. The output of inverter 516 is supplied directly through a signal line 520 and a diode 522 into terminal 389. The same signal is applied through a capacitor 526 (FIG. 4*a*) and resistor 317 in parallel with diode 319 to the input of NOR gate **352-*b* in the control circuit (FIG. 4***b*) via terminal 321. Thus connected, the power on/reset circuit 86 functions as a timing circuit used to sense the power/off mode on the control line 32. That is, when the control line 32 voltage is below 1.5 volts for a predetermined length of time, the voltage across capacitor 510 (FIG. 4*a*) is pulled sufficiently high enough in a time period determined by the value of resistor 512 to cause inverters 514, 516 to change logic state by virtue of the 2.5 volt threshold applied to the input terminal of inverter 514. Once this occurs, the timing capacitor 527 (FIG. 4*b*) coupled to the ramp select section of the tone generator is discharged by means of diode 522. Simultaneously, when the power to the control head is once again turned on, a reset pulse is produced by the change of state of inverter 516 which is sent via capacitor 526 to the control circuits of the tone generator. This reset pulse is used to reset the flip-flop 392 (FIG. 4*b*) to its required starting state.

High Voltage Protection Circuit

This circuit 74, which appears in detail in FIG. 4*a*, monitors the supply voltage through a zener diode 540 connected thereto. If this voltage becomes excessive, e.g. above 16.5 VDC, the micro-circuit amplifier 542 thereof, conditioned by a bias network of resistors 544, generates an output signal at terminal 546 which is applied to decoder 270. This changes the decoder address, thus disabling the output. This circuit is, again, described in the afore-referenced U.S. Pat. No. 4,189,718.

From the above description, it will be seen that the present invention provides a unique electronic siren circuit which provides a remote control unit which is of small size so that it can be mounted in limited space in a vehicle in a position convenient for an operator to use. Simultaneously, all of the relatively bulky, high power portions of the siren circuit can be mounted in a separate module and installed in any convenient location of the vehicle. Communication between the remote control head and the receiver circuit is effected entirely through a single conductor. This communication includes both the transmission of digital coded information for producing various desired siren sounds and intelligible audio signals from a microphone in the vehicle, these signals being fed through the control head circuitry. The circuit provides complete control and safety functions including automatic shut-off in response to excessively low frequency, protection against excessive voltages, and permits full flexibility in the selection and intermingling of siren functions. A novel biasing circuit automatically reduces the control biasing current load of the receiver amplifier whenever the unit is in a standby state thereby obviating the need for a separate on/off switch and additional conductors, thereby maintaining the receiver-amplifier in a ready state at all times without any deleterious effects on the vehicle electrical system. The drawings and specification disclose a working embodiment of the invention, and the values and parameters, listed in the following table, of components used in this working embodiment are exemplary only and other values and variations thereof may be used without departing from the spirit and scope of the invention.

| RESISTORS (K-1000 ohms) | |
|---|---|
| 200, 256, 223, 294 | 100 |
| 110, 192 | 330 |
| 220, 248, | 1K |
| 252, 254, 266, | |
| 184, 450 | 1K variable |
| 126, 150, 172, 190, 244, 286, 306 | 4.7K |
| 483 to 456, to 458, to 492 | 4.7K |
| 146, 512_ | 12K |
| 430, to Q | 75K |
| 274 | 100K |
| 208, 210, 212 | 2.2K |
| 317 | 22K |
| **CAPACITORS** | |
| 98, 104, 144 | micro farads |
| 510, to 392 "D" | 6.8 |
| 250, 258 | .01 |
| 276 | 0.1 |
| 526, 236 | .047 |
| 428 | .47 |
| 527 | 150 μf |
| Receiver power supply 18 | |
| in. .01, .47, 220 | |
| out. .01, .47, 220 | |
| **INTEGRATED CIRCUITS** | |
| NOR gates (all) | MC 14001 |
| OR gates (all) | MC 14071 |
| Inverters (all) | MC 14069 |
| Flip-flop 392 | MC 14013 |
| Regulator 100 | MC 7805 |
| Regulator 502 | MC 7808 |
| Ramp select 532 | MC 14052 |
| Ramp generator 534 | MC 1455 |
| Op. Amp. in 68 | MC 1458 |
| Decoder 270 | MC 145027 |
| Encoder 135 | MC 145026 |
| Diodes (all) | 1N 4003 or 1N 4148 |

(Note - components not labeled - see U.S. Pat. No. 4,189,718. Timing and control elements for micro-circuits as specified by manufacturer.)

While there have been described above the principles of this invention in connection with specific apparatus, it is to be clearly understood that this description is made only by way of example and not as a limitation to the scope of the invention.

What is claimed is:

1. In remote control electronic siren apparatus:

(a) a control module including function switch means for generating a selected one of a predetermined plurality of parallel binary coded function switch signals, and encoding means connected to said function switch means to receive said function switch signals for generating in response thereto a corresponding one of a plurality of sequentially occurring serial coded pulse signals;

(b) a receiver module located remotely from said control module;

(c) transmission line means in the form of a single conductor control line for connecting said receiver module to said control module to conduct said serial coded pulse signals from said control module to said receiver module;

(d) decoding means constituting a portion of said receiver module, said decoding means receiving said serial coded pulse signals and producing in response thereto corresponding static parallel output signals;

(e) siren signal generating means constituting a portion of said receiver module, said siren signal generating means being responsive to said static parallel output signals for generating a corresponding predetermined plurality of variable frequency signals having frequency envelopes corresponding to predetermined siren formats;

(f) power amplifier means constituting a portion of said receiver module, said power amplifier means being responsive to said variable frequency signals to drive a loudspeaker generating high volume audible signals corresponding thereto; and (g) a power amplifier bias switch constituting a portion of said receiver module, said power amplifier bias switch automatically altering the biasing current of said power amplifier in response to the presence or absence of a signal provided by said control module via said transmission line.

2. The apparatus of claim 1 wherein said control module further includes means for selectively generating intelligible audio signals, output circuit means connected to receive said serial binary coded pulse signals and said intelligible audio signals and including encoder output control means responsive to operation of said intelligible audio signal means for disabling said encoding means and transmitting said audio signals.

3. The apparatus of claim 2 wherein said means for generating intelligible audio signals includes a microphone having a manually operable microphone switch, said output circuit means being responsive to operation of said microphone switch to generate an encoder disabling signal, said encoding means including a disabling signal input circuit responsive to said encoder disabling signal to terminate transmission of said serial coded pulse signals in response thereto.

4. The apparatus of claim 3 wherein said disabling signal is a voltage signal variable between predetermined high and low voltage levels above and below a predetermined value, said encoding means being operable between an active state when the input voltage thereto is below said predetermined value and an inactive state when said input voltage is above said predetermine value, respectively, said output circuit means including a logic circuit connected to said microphone button and operable between alternate logic states in response to opening and closing thereof, respectively, one of said alternate logic states being in a voltage above said predetermined value, and the other thereof being a voltage below said value.

5. The apparatus of claim 4 wherein said output circuit means further includes a time delay circuit connected between said logic circuit and said encoder disabling signal input circuit.

6. The apparatus of claim 5 wherein said delay circuit includes a resistor-capacitor network.

7. The apparatus of claim 2 wherein said output circuit means includes biasing circuit means for applying a predetermined biasing signal to said transmission line means in response to operation of said microphone switch.

8. The apparatus of claim 7 wherein said power amplifier means includes at least one transformer, said biasing circuit means being coupled thereto through said transmission line means and including a switching transistor, said switching transistor being operable between conductive and non-conductive states in response to the inductive reactance of said transformer and operation of said microphone switch.

9. The apparatus of claim 7 wherein said receiver circuit further includes a public address switch circuit operable between conductive and said non-conductive states in response to the presence and absence of said biasing signal, respectively.

10. The apparatus of claim 9 wherein said receiver circuit includes input amplifier means having an input terminal connected to said transmission line to receive signals therefrom and output circuit means for generating a pulse output signal corresponding to said serial coded pulse signal and generating a direct current signal in response to said biasing signal, respectively.

11. The apparatus of claim 10 said public address switch circuit includes a capacitive charging circuit connected to said input amplifier output circuit means, said capacitive circuit being charged in response to said pulse output signal, and further including a transistor switch operatively coupled to said capacitive circuit, said transistor switch being rendered non-conductive in response to charging of said capacitor and being conductive when said capacitor is discharged.

12. The apparatus of claim 11 wherein said decoding means is coupled to said input amplifier output circuit means, said decoding means being operative in response to said pulse output signal to generate said static parallel binary coded control signals and being disabled in response to said direct current signal.

13. The apparatus of claim 1 wherein said power amplifier bias switch means includes a transistor switch operable between a first conductive state for applying high current biasing to said power amplifier in response to the presence of signals of said transmission line and a second conductive state for applying low current biasing thereto in the absence of said signal.

14. In remote control electronic siren apparatus:

(a) a control module including function switch means for generating a selected one of a predetermined plurality of parallel binary coded function switch signals, encoding means connected to said function switch means to receive said function switch signals for generating in response thereto a corresponding one of a plurality of sequentially occurring serial coded pulse signals, means for selectively generating intelligible audio signals, and control module output circuit means connected thereto and to said encoding means for receiving said serial coded pulse signals and said intelligible audio signals and for disabling said encoding means and transmitting said intelligible audio signals in response to the presence of said intelligible audio signals;

(b) a receiver module located remotely from said control module;

(c) transmission line means in the form of a single electrical conductor for connecting said receiver module to said control module to conduct said serial coded pulse signals and said intelligible audio signals from said control module to said receiver module;

(d) receiver input circuit means constituting a portion of said receiver module, said receiver input circuit means being connected to said single conductor to receive said serial coded pulse signals and said intelligible audio signals, for amplifying said serial coded pulse signals, and for generating an audio signal switch control signal in response to said intelligible audio signals, respectively;

(e) decoding means constituting a portion of said receiver module, said decoding means connected to said receiver input circuit means for receiving said serial coded pulse signals and producing in response thereto corresponding static parallel output signals;

(f) siren signal generating means constituting a portion of said receiver module, said siren signal generating means being responsive to said static parallel output signals for generating a corresponding predetermined plurality of variable frequency signals having frequency envelopes corresponding to predetermined siren format;

(g) a public address switch circuit constituting a portion of said receiver module and being connected to said receiver input circuit means and being rendered conductive in response to said audio signal switch control signal;

(h) power amplifier means constituting a portion of said receiver module, said power amplifier means being responsive to said variable frequency signals and being coupled to said siren signal generating means and to said public address switch circuit, said power amplifier means driving a loudspeaker for generating high volume audible signals in response to a respective one of said variable frequency signals and said intelligible audio signals, said siren signal generating means being operatively coupled to said decoding means and responsive to said serial coded pulse signals to generate corresponding ones of said variable frequency signals; and (i) a power amplifier bias switch constituting a portion of said receiver module, said power amplifier bias switch automatically altering the biasing current of said power amplifier in response to the presence or the absence of a signal provided by said control module via said transmission line.

15. The apparatus of claim 14 wherein said control module further includes output control means responsive to said intelligible audio signals for disabling said encoding means and transmitting said audio signals.

16. The apparatus of claim 15 wherein said means for generating intelligible audio signals includes a microphone having a manually operable microphone switch, said output circuit means being responsive to operation of said microphone switch to generate an encoder disabling signal, said encoding means including a disabling signal output circuit responsive to said encoder disabling signal to terminate transmission of said serial binary coded signals in response thereto.

17. The apparatus of claim 16 wherein said disabling signal is a voltage signal variable between predetermined high and low voltage levels above and below a predetermined value, said encoding means being operable between an active state when the input voltage thereto is below said predetermined value and an inactive state when said output voltage is above said predetermined value, respectively, said output circuit means including a logic circuit connected to said microphone button and operable between alternate logic states in response to opening and closing thereof, respectively, one of said alternate logic states being a voltage above said predetermined value, and the other thereof being a voltage below of said value.

18. The apparatus of claim 1 wherein said power amplifier biasing switch means includes a transistor switch operable between a first conductive state for applying high current biasing current to said power amplifier in response to the presence of signals on said transmission line and a second conductive state for applying low current biasing signals thereto in the absence of said signals.

19. In remote control electronic siren apparatus:

(a) a control module including encoding means for generating a selected one of a predetermined plurality of coded signals;

(b) a receiver module located remotely from said control module;

(c) transmission line means in the form of a single electrical conductor for connecting said receiver module to said control module to receive said coded signals;

(d) decoding means constituting a portion of said receiver module, said decoding means receiving said coded signals and producing in response thereto one of a corresponding plurality of output control signals;

(e) siren signal generating means constituting a portion of said receiver module, said siren signal generating means being for generating a corresponding predetermined plurality of variable frequency signals having frequency envelopes corresponding to predetermined siren formats;

(f) power amplifier means constituting a portion of said receiver module, said power amplifier means being responsive to said variable frequency signals, and being coupled to said signal generating means, said power amplifier driving a loudspeaker for generating high volume audible signals in response to said variable frequency signals, said siren signal generating means being operatively coupled to said decoding means and responsive to said coded signals to generate corresponding ones of said variable frequency signals; and (g) a power amplifier bias switch constituting a portion of said receiver module, said power amplifier bias switch automatically altering the biasing current of said power amplifier in response to the presence or absence of a signal provided by said control module via said transmission line.

20. The apparatus of claim 19 wherein said control module further includes means for selectively generating intelligible audio signals, output circuit means connected to receive said coded function signals and said intelligible audio signals, and including encoder output control means responsive to said intelligible audio signals for disabling said encoding means and transmitting said audio signals.

21. The apparatus of claim 20 wherein said means for generating intelligible audio signals includes a microphone having a manually operable microphone switch, said output circuit means being responsive to operation of said microphone switch to generate an encoder disabling signal, said encoding means including a disabling signal input circuit responsive to said encoder disabling signal to terminate transmission of said coded signals in response thereto.

22. The apparatus of claim 21 wherein said disabling signal is a voltage signal variable between predetermined high and low voltage levels above and below a predetermined value, said encoding means being operable between an active state when the input voltage thereto is below said predetermined value and an inactive state when said input voltage is above said predetermined value, respectively, said output circuit means including a logic circuit connected to said microphone button and operable between alternate logic states in response to opening and closing thereof, respectively, one of said alternate logic states being a voltage above said predetermined value, and the other thereof being a voltage below said value.

23. The apparatus of claim 22 wherein said output circuit means further includes a time delay circuit connected between said logic circuit and said encoder disabling signal input circuit.

24. The apparatus of claim 23 wherein said output circuit means includes biasing switch circuit means for applying a predetermined direct current biasing singal to said transmission line means in response to operation of said microphone switch.

25. In an electronic siren apparatus, a control module operable between power "on" and power "off" states, and a remotely located receiver module operable continuously under a power "on" state, a single conductor transmission line for conducting signals between said modules, said control module including function switch means for generating selectively one of a plurality of siren signals, intelligible audio signals and power "on" and "off" signals and applying such signals to said transmission line means, a power "on" signal being generated by said control module when in power "on" state, a power "off" signal being generated when in power "off" state, power amplifier means in said receiver module for reproducing in audible form selected ones of said signals, biasing means responsive to selected ones of said signals for altering the mode of operation of said power amplifier means to correspond to siren, intelligible and power "on-off" signals, said biasing means being responsive to a power "on" signal to bias said power amplifier means to reproduce said siren and intelligible signals and further responsive to a power "off" signal to bias said power amplifier means to a condition of predetermined low level power consumption.

26. The apparatus of claim 25 wherein said biasing means biases said power amplifier means to a class B mode operation in response to said siren signals and to a Class AB mode in response to said intelligible signals.

27. The apparatus of claim 25 wherein said biasing means includes input switch means serially connected with said transmission line means between said control and receiver modules for controlling the application of said intelligible signals to said power amplifier, said input switch means including gating means for rendering said input switch means conductive of said intelligible signals in response thereto and non-conductive in response to said siren signals.

28. The apparatus of claim 27 wherein said biasing means includes bias switch means connected between said input switch means and said power amplifier responsive to a power "on" signal for biasing said power amplifier to a condition in which it can reproduce said siren and intelligible signals and further responsive to a power "off" signal for biasing said power amplifier to said condition of low level power consumption.

29. The apparatus of claim 28 including an input circuit serially connected in said transmission line means between said conductor and said input switch means, said input circuit generating a logic zero signal responsive to the presence of intelligible signals on said conductor and a logic one signal responsive to the presence of a siren signal on said conductor, said bias switch means being connected to said input circuit and responsive to said logic zero signal for biasing said power amplifier to said predetermined lower level power consumption.

* * * * *